US006902414B2

(12) United States Patent
Dopf et al.

(10) Patent No.: US 6,902,414 B2
(45) Date of Patent: Jun. 7, 2005

(54) HARSH ENVIRONMENT ROTATABLE CONNECTOR

(75) Inventors: Anthony R. Dopf, Calgary (CA); Derek W. Logan, Calgary (CA); David Switzer, Calgary (CA)

(73) Assignee: Extreme Engineering Ltd., Calgary (CA)

( * ) Notice: Subject to any disclaimer, the term of this patent is extended or adjusted under 35 U.S.C. 154(b) by 0 days.

(21) Appl. No.: 10/671,835

(22) Filed: Sep. 29, 2003

(65) Prior Publication Data

US 2005/0070141 A1 Mar. 31, 2005

(51) Int. Cl.[7] ..... H01R 13/44
(52) U.S. Cl. ..... 439/140; 439/141
(58) Field of Search ..... 439/140, 141, 439/131–132

(56) References Cited

U.S. PATENT DOCUMENTS 3,508,188 A * 4/1970 Buck ..... 439/141
4,676,574 A 6/1987 Grosso et al.
4,997,384 A 3/1991 Godfrey et al.
5,048,914 A 9/1991 Sneddon
5,131,464 A 7/1992 Lenhart et al.
5,203,805 A 4/1993 Cairns
5,334,032 A * 8/1994 Myers et al. ..... 439/140
5,334,801 A 8/1994 Mohn
5,358,418 A 10/1994 Carmichael et al.
5,389,003 A 2/1995 Van Steenwyk et al.
5,484,296 A * 1/1996 Taylor ..... 439/140
5,820,416 A 10/1998 Carmichael
5,823,806 A * 10/1998 Nagase et al. ..... 439/140
6,123,561 A 9/2000 Turner et al.
6,392,317 B1 5/2002 Hall et al.
6,511,335 B1 1/2003 Rayssiguier et al.

* cited by examiner

*Primary Examiner*—J. F. Duverne
(74) *Attorney, Agent, or Firm*—Gowling Lafleur Henderson LLP; Robert M. Hendry

(57) ABSTRACT

A rotatable plug and socket for establishing electrical communication in a hazardous environment, each of said plug and socket having biased slidable protective members covering electrical contacts on each of said plug and socket, which are each slidably displaced during mating engagement of the plug with the socket. The slidable protective members ensure protection of the electrical contacts on each of the plug and socket members when such plug and socket connectors are not engaged, or not fully engaged. Such plug and socket connectors are particularly suited for location within respective sections of two drill pipe used in petroleum drilling operations, where such sections of drill pipe are desired to be rotatably secured together and it is desired to establish at the same time mating engagement of such plug and socket connector respectively in each of such two drill pipes so as to establish electrical communication between electronic circuitry and devices situate in one of the drill pipes with associated electronic circuitry and/or devices situate in the other of such two drill pipes.

27 Claims, 13 Drawing Sheets

HARSH ENVIRONMENT ROTATABLE CONNECTOR

FIELD OF THE INVENTION

This invention relates to electrical connections, and more particularly to apparatus for the safe electrical connection of electrical components in harsh environments such as in oil well drill strings.

BACKGROUND OF THE INVENTION AND DESCRIPTION OF THE PRIOR ART

In oilfield and gas drilling operations, electronic equipment such as pressure probes, directional sensing probes, and the like are typically all located together down-hole in a well-bore and co-axially within one drill pipe of a multi-pipe drill string. The probes each have multiple electrical contacts which require electrical mating connection to be made with a mating electrical connection in an up-well segment of another drill pipe/collar. The up-well drill pipe typically contains additional electronic equipment such as a battery power supply as well as transmitting equipment powered by such battery power supply, for powering such sensors in said down-hole pipe and for powering transmitters for transmitting information received from such sensors via the mating electrical connection up-well to surface receptors and data recorders.

More particularly, in an underground drilling environment, measurement or logging instruments are often employed to provide information regarding the drilling status, performance or environment. This information may be stored in memory or telemetered to surface in real time. The measurement and/or telemetry tools are typically battery or generator powered and both the electronics and batteries are contained in pressure resistant housings mounted concentrically along the central axis of the drill collars forming an annulus within the drill pipe through which high-pressure drilling fluid is passed.

The measurement/telemetry tools of the type described above must withstand extremes of pressure, vibration and temperature. Depending on the combination of measurement/telemetry tools chosen, they may exceed the approximate 30' length of standard drill pipe/collars, or specific sensors may be rigidly fixed to shorter sections of modified drill collars. In this case, electrical tools must span more than one drill collar. Difficulty occurs with the need to simultaneously mate and unmate both the drill collars and the internal electrical housings, yet do so in a manner in which the electrical connections are shielded from the environment to not only protect the electrical connections from a corrosive, potentially explosive, and/or wet environment which would be detrimental to establishing electrical connection, but also from physical damage or deformation to the electrical connectors during the mating and un-mating connection of drill strings and the associate required mating and un-mating connection of electrical connectors axially situate within respective adjacent drill pipe/collars.

In addition, a further problem arises where mating connection between co-axial male plug and mating female socket connections are required to establish such electrical connection. In particular, where electrical connection is required between a coaxial male plug, having multiple circumferential spaced apart electrical contacts thereon, and a female socket connector having a mating diameter and a corresponding number of electrical contacts thereon. Specifically, the procedure of engaging a male plug having a plurality of circumferential electrical connections thereon within a coaxial female socket aperture so as to form the electrical connection with the multiple electrical contacts thereon will cause many of the contacts in the male plug to "wipe" past those of the female socket during insertion, generally in an electrically inappropriate manner, that may damage the electronic circuits associated with such contacts before the contacts are each fully and appropriately engaged with the responding electrical contact. In addition, a further problem arises in that the preferred method of making such electrical connections is typically to insert by rotationally screwing one tubular housing containing the male plug into a similar tubular housing containing the female socket. The environment in which this occurs could also be hazardous—for instance, on the floor of an oil-drilling rig where flammable gases may be present. In such circumstances it is advisable to make certain that no potentially live electrical contacts are capable of causing a spark or thermal effect that could ignite flammable gas, dust or vapor during rotatable insertion of the male plug into the female socket.

Accordingly, a means and apparatus to allow for the joining of the internal electrical connections is desired, and in particular in a down-hole drilling application to allow electrical connection between electronic componentry located in two or more separable drill pipes to be accomplished.

Referencing U.S. Pat. Nos. 6,123,561, 6,392,317, and 5,334,801, prior methods for drill collar electrical connections have included electrical connectors integral to the drill collars. This arrangement requires specialized drill collars, and makes required recutting of the mating threads an additional step and expense, and also requires a method to transfer the electrical leads back and forth between drill collars and internal electrical components.

Additional patents such as U.S. Pat. Nos. 5,389,003, 6,439,932, and 5,358,418 teach a class of connectors referred to as "wet connects". These connectors, while primarily employed to make electrical connections down-hole between a wireline cable and probe, have also been employed in an attempt to make interconnections between probes mounted in drill collars. The art is not well suited for this application, as the wet connects tend to be elongated to the point that they extend out of the drill collar connections, making them subject to damage. Further, the unconnected contacts are generally exposed, and this makes safety a concern in hazardous environments, where the exposed contacts could create a spark.

SUMMARY OF THE INVENTION

In order to overcome certain of the disadvantages of the prior art, the present invention in a broad aspect thereof provides two connector halves matingly engageable in co-axial arrangement, where the electrical contacts on each of the connector halves are physically covered in order to protect electrical contacts on each of said connector halves from environmental damage. The first connector half (which includes a male member on the plug means) is protected by a resiliently-biased outer insulating sleeve or sheath. The sheath contains one or more seals and acts to shield electrical contacts on the male member from dirt, corrosion, or the like.

The second connector half (the socket means) has a female receptacle, the inner periphery of which possesses a plurality of electrical contacts (corresponding to the number of electrical contacts on the male member). The electrical contacts within the female receptacle are protected by a resiliently-biased movable member, which in a preferred embodiment is a sliding piston member. The piston member and/or female receptacle includes one or more seals to shield electrical contacts within the female receptacle from the environment.

In a preferred embodiment, such as where the connector halves are installed respectively in mating drill pipes, the two connector halves are each contained in pressure-resistant housings which support and centrally locate the connector halves within the respective drill pipe, and are capable of withstanding external pressure.

During the connection of the two connector halves, namely the plug and socket means, the male member on the plug means displaces the resiliently-biased piston member while the socket member displaces the resiliently-biased sheath member. The connector halves each continue to displace the protective shields on the mutually opposite connector half until mating engagement is complete, at which time the male member should be fully inserted in the female receptacle means, and each of the electrical contacts on each of the male member and the female receptacle means are properly aligned. This fully-engaged position may also be determined when the respective pressure-resistant housings containing each connector half shoulder against one other at which time the connectors have reached proper alignment of all respective co-axial conductors.

In the preferred embodiment where each of such connector halves are fixedly installed respectively within the interior of mating drill pipes which are then threadably coupled together, a third resiliently biasing means, such as a spring, may further be provided. Such further resilient biasing member functions, during threading of the drill members together and thereafter, to exert a force to ensure that the connectors remain fully mated while allowing for some variation in the length of the threaded members.

In a further aspect to the present invention, when such plug and socket means are each contained in respective mating pressure housings [which assist in preventing exterior liquids and gases from coming into contact with electrical contacts of such plug and socket means as is necessary when such plug and socket means are installed respectively in mating drill pipes], at least one of the pressure housings may be configured in such a way so as to utilize the ambient pressures surrounding such housings and within such drill pipe to exert a force which assists in maintaining the pressure housings containing such plug and socket means in mating engagement.

In a preferred embodiment, electrical switching circuits are connected to the electrical contacts situate on one or both of said male member and female receptacle means. Such electrical switching circuits serve to prevent the flow of electrical power to respective electrical contacts in either or both the male member or female receptacle means until the connecting halves are fully mated. Through the electrical switches, the multiple electrical contacts of the male and female connectors are electrically isolated (ie "switched off") as they slide past one another, and are only electrically powered after mating engagement of the plug means with the socket means is complete.

During unmating, the electrical switches cut power prior to the conductors sliding past each other. The resiliently-biased sheath and piston member move back over the electrical contacts so as to again cover and thus protect the electrical contacts from the environment. Reference is to be had to pending U.S. patent application Ser. No. 10/655,028 filed Sep. 4, 2003 assigned to the same entity as this within application, the entity of the subject matter of which is incorporated herein by reference.

Accordingly, in one of its broad embodiments the present invention is to a plug and socket means adapted for mating engagement, for establishing electrical communication there between in a hazardous environment. The plug means comprises:

a) an elongate male member, having a plurability of electrical contacts about an outer periphery thereof;

b) a resiliently-biased sheath member, slidably biased over said male member so as to substantially cover said electrical contacts on said male member, which upon application of force thereto may be slidably moved so as to uncover said electrical contacts; and c) biasing means for biasing said slidable sheath member over said male member.

The socket means comprises:

a) elongate receptacle means having disposed about an inner periphery thereof a plurality of electrical contacts, said electrical contacts adapted to contact said electrical contacts respectively on said male member when said male member is inserted in said receptacle means;

b) resiliently-biased protective means displaceable from said receptacle means so as to permit insertion of said male member within said receptacle means; and c) biasing means, biasing said protective means so as to prevent ingress of any foreign material into said receptacle means when said male member is not yet inserted in said receptacle means.

The male member is adapted for insertion in the receptacle means upon mating engagement of the plug means with said socket means.

In a preferred embodiment the resiliently-biased protective means comprises a piston member, slidably-biased within said receptacle means, adapted to substantially cover said electrical contacts disposed on said inner periphery of said female receptacle means when said male member is not yet inserted in said female receptacle means. The piston member is displaceable from within said receptacle means by the male member upon insertion of said the member in said receptacle means.

In yet a further refinement, the socket means further comprises means for contacting the sheath member upon mating engagement of said plug means with said socket means, so as to cause said sheath member to be slidably displaced from a position covering said male member as said male member is inserted in said receptacle means.

In a preferred embodiment, the plug means and socket means is contemplated for use in two separate drill pipes which are desired to be matingly engaged to one another during drilling, typically by threadable engagement, and more particularly is contemplated as providing apparatus for establishing electrical connection between a plug means and associated electrical componentry in one drill pipe, and a socket means and its associated electrical componentry located within another drill pipe which will be connected to one another during drilling. In such embodiment the plug means is adapted for positioning within an interior of a first drill pipe proximate an end thereof, said end of said drill pipe adapted for mating engagement with a mating end of another drill pipe, and said socket means is adapted for positioning within an interior of said another drill pipe proximate said mating end thereof; wherein said male member is adapted for insertion in said receptacle means upon said first drill pipe being fitted in mating engagement with said another drill pipe.

More particularly, in an embodiment of the invention contemplated for use in drill pipe, for establishing electrical connection between electrical componentry in each of two respective drill pipes, the present invention comprises plug and socket means adapted for respective positioning within two separate drill pipes and adapted to permit electrical communication between components situated in each of said two separate drill pipes and further adapted for mating engagement upon rotatable engagement of said two separate drill pipes with each other; said plug means comprising:

a) an elongate male member, having a plurality of electrical contacts about an outer periphery thereof;

b) a resiliently-biased sheath member, slidably biased over said male member so as to substantially cover said electrical contacts on said male member, which upon application of force thereto may be slidably moved so as to uncover said electrical contacts; and c) biasing means for biasing said slidable sheath member over said male member;

said socket means comprising:

a) elongate receptacle means having disposed about an inner periphery thereof a plurality of electrical contacts, said electrical contacts adapted to contact said electrical contacts respectively on said male member when said male member is inserted in said receptacle means;

b) resiliently-biased protective means displaceable from said receptacle means so as to permit insertion of said male member within said receptacle means; and c) biasing means, biasing said protective means so as to substantially prevent ingress of foreign material into said receptacle means when said male member is not yet inserted in said receptacle means;

wherein said male member is adapted for insertion in said receptacle means upon mating engagement of said plug means with said socket means.

In yet a further preferred embodiment, particularly suited where the plug means and the socket means are contemplated each for location in two separate drill pipe which are to be rotatably engaged with each other during drilling, the plug means is rotatable relative to said socket means to permit said socket means to rotate relative to said plug means during rotatable mating engagement of said two separate drill pipes with each other.

In a further refinement of the embodiment of the invention contemplated for use in association with two separate drill pipes, said plug means is adapted for positioning within an interior of a first of said two separate drill pipes proximate an end thereof adapted for mating engagement with a mating end of a second of said two separate drill pipes, and said socket means is adapted for positioning within an interior of said second of said two separate drill pipes proximate said mating end thereof; and said male member is inserted in said receptacle means upon said first drill pipe being fitted in mating engagement with said second drill pipe.

In a further embodiment, due to a problem that when the male member is inserted within the female member there may temporarily be inappropriate electrical contact made due to electrical contacts on the male member "wiping" past the electrical contacts on the elongate receptacle means until full engagement of the male member within the female receptacle means, in a preferred embodiment means is further provided to avoid such inadvertent and inappropriate connections being temporarily made which would otherwise possibly result in damage to associated electrical circuitry.

Accordingly, in a further preferred embodiment, said plurality of electrical contacts disposed about said periphery of said male member comprise first and second plug contacts, electrically coupled to each other via plug-side current direction-limiting means; said plurality of electrical contacts disposed about said inner periphery of said receptacle means comprising first and second socket contacts, situate in said receptacle means and adapted to correspondingly come into electrical contact respectively with said plug contacts when said plug means is properly and fully matingly engaged with said socket means, said first and second socket contacts electrically coupled to each other via socket-side current direction-limiting means; at least one additional plug contact and socket contact on each of said plug and socket means, respectively, each similarly adapted to come into electrical contact with each other when said plug means is fully matingly engaged with said socket means; wherein said plug and socket means are each adapted to be used with circuit isolation means capable of only permitting flow of electrical current through said at least one additional plug and socket contact when current flow through at least one of said plug side and socket side current direction-limiting means is detected. Reference is to be had to U.S. patent application Ser. No. 10/655,028 filed Sep. 4, 2003 assigned to the same entity as the written application, the entire contents of which are incorporated herein by reference.

In yet a further embodiment, third biasing means (in addition to the biasing means possessed by each of the plug means and socket means) is further provided. Such third biasing means is adapted, when said plug means and said socket means are in mated engagement, to exert a force so as to maintain said plug means in mating engagement with said socket means. This feature is particularly advantageous where the plug and socket connectors are subjected to vibrations and jarring, typical of the types of environmental stresses subjected to drill strings during drilling.

In a preferred embodiment, were the plug and socket are intended to be used in respective mating drill pipes, the socket means is contained in a first pressure housing, said first pressure housing attachable to an interior of said first drill pipe. The plug means is contained in a second pressure housing, said second pressure housing positionable within an interior of said second drill pipe; a portion of the second pressure housing being slidably moveable within a third pressure housing, said third pressure housing attachable to an interior of said second drill pipe; and the second pressure housing is matingly engageable with said first pressure housing along a common longitudinal axis.

In a further refinement of the invention where the plug and socket means are contained in pressure housings, the second pressure housing is provided with an area of reduced cross-sectional area so as to present a surface area normal to said longitudinal axis of said first and second pressure housing so that ambient pressure within said first and second drill pipes acts on said surface area so as to cause said second housing to be biased in mating engagement with said first housing.

Likewise, instead of locating the socket means within the first pressure housing member and the plug means within the second pressure member, the order may be reversed. Accordingly, in such embodiment, the plug means is contained in the first pressure housing, said first pressure housing attachable to an interior of said first drill pipe; the socket means is contained in the second pressure housing, said second pressure housing positionable within an interior of said second drill pipe; a portion of the second pressure housing is slidably moveable within a third pressure housing, said third pressure housing attachable to an interior of said second drill pipe; and the second pressure housing is matingly engageable with said first pressure housing along a common longitudinal axis.

Likewise, in a further refinement of the above embodiment where the plug and socket are intended to be used in respective mating drill pipes, the second pressure housing is provided with an area of reduced cross-sectional area so as to present a surface area normal to said longitudinal axis of said first and second pressure housing so that ambient pressure within said first and second drill pipes acts on said surface area so as to cause said second housing to be biased in mating engagement with said first housing.

Lastly, in yet another aspect of the present invention, such invention provides for a method for establishing electrical communication between a plug means in a first drill pipe and a socket means in a second drill pipe, comprising the steps of:

i) positioning said plug means within an interior of said first drill pipe, proximate to a first end thereof;

ii) positioning said socket means within an interior of said second drill pipe proximate a first end thereof, said first end of said first drill pipe adapted for rotatable engagement with said first end of said second drill pipe;

iii) rotatably securing said first end of said first drill pipe to said first end of said second drill pipe, while at the same time simultaneously:

a) inserting a male member having a plurality of electrical contacts thereon arranged about an outer periphery and situate within said first drill pipe, into a receptacle means on said socket means having a plurality of mating electrical contacts thereon arranged about an inner periphery thereof so that each respective electrical contacts on said male member come into respective contact with said electrical contacts within said receptacle means;

b) displacing, with said male member, a resiliently-biased piston member situate in said receptacle means; and c) displacing, with said socket means, a sheath member covering said male member.

BRIEF DESCRIPTION OF THE DRAWINGS

Further advantages and permutations will appear from the following detailed description of various non-limiting embodiments of the invention, taken together with the accompanying drawings, in which.

DETAILED DESCRIPTION OF A PREFERRED EMBODIMENT

The description will be made in reference to the invention being used to connect electrical equipment mounted concentrically within drill collars or drill pipes, for drilling boreholes in the earth, although the invention has application in electrically connecting any mating members.

Figure 1:
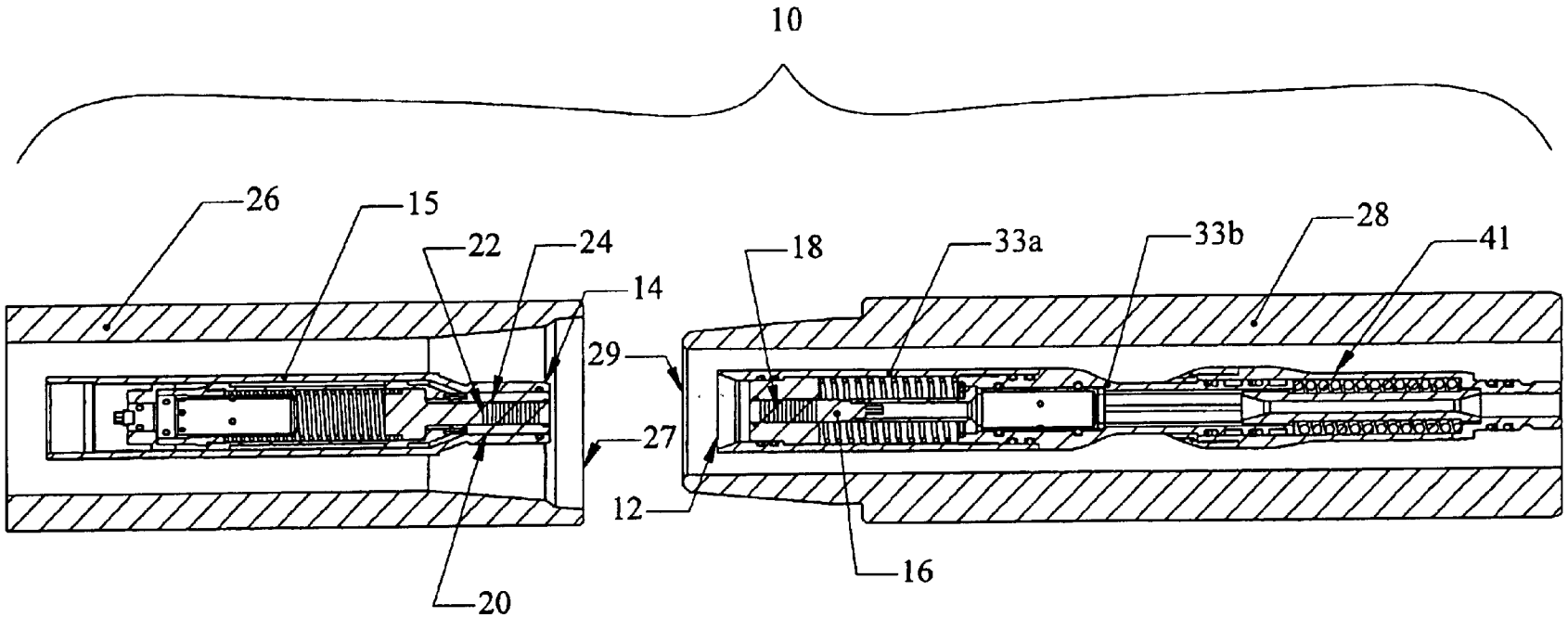
FIG. 1 is a cross section of two separate drill pipes, each containing a respective connector half, with the left-hand drill pipe and associated connector half comprising the socket means and possessing a female receptacle means having a plurality of electrical contacts disposed about an inner periphery thereof, and the right-hand drill pipe and associated connector comprising the plug means and possessing a male member having electrical contacts disposed about an outer periphery thereof.

Referencing FIG. 1, the plug and socket assembly 10 of the present invention consists of two matingly engageable half-members, namely a plug means 12 and a socket means 14. Plug means 12 contains a male member 16, having a plurality of electrical contacts 18 thereon, circumferentially disposed about a periphery of said male member 16. Plug means 12 is disposed in pressure housing 33*a,* which in turn is matingly engaged to pressure housing 33*b,* a portion of which is slidable in pressure housing 41. Socket means 14 comprises a female receptacle 20, having a plurality of circumferential electrical contacts 22 disposed about an inner periphery 24 of said receptacle 20.

In a preferred embodiment, socket means 14 and associated receptacle 20 and pressure housings 15 are positionable in a first drill pipe 26, and plug means 12 and associated male member 16 are positionable within a second drill pipe 28, as shown in FIG. 1. Socket means 14 is situated within a pressure housing 15, and plug means 12 is situated within pressure housing 33*a,* as more fully explained below.

In typical drilling rig operating conditions, the female end 27 drill pipe 26 faces upward, and the male end 29 of drill pipe 28 is lowered down to it by using a winch or similar system, and thereafter rotated so as to permit mating engagement of drill pipes 26,28 together. However, in lowering pipe 28 onto pipe 26, it is typical that the male end 29 of the drill pipe 28 will on occasion swing across the female end 27 of drill pipe 26, and would severely damage plug means 12 if it were to protrude from male end 29 of drill pipe 28. Similarly, socket means 14 could be similarly damaged if it were to protrude from female end 27 of drill pipe 26 by male end 29 of drill pipe 28. Accordingly, in a preferred embodiment, each of plug means 12 and socket means 14 are recessed from the respective male and female ends 29, 27 of drill pipes 28, 26 respectively, in order that plug means 12 and male member 16 thereon as well as socket means 14 and receptacle 20 thereon are protected from inadvertent contact with and potential damage during handling of the drill pipes 26, 28.

Figure 2:
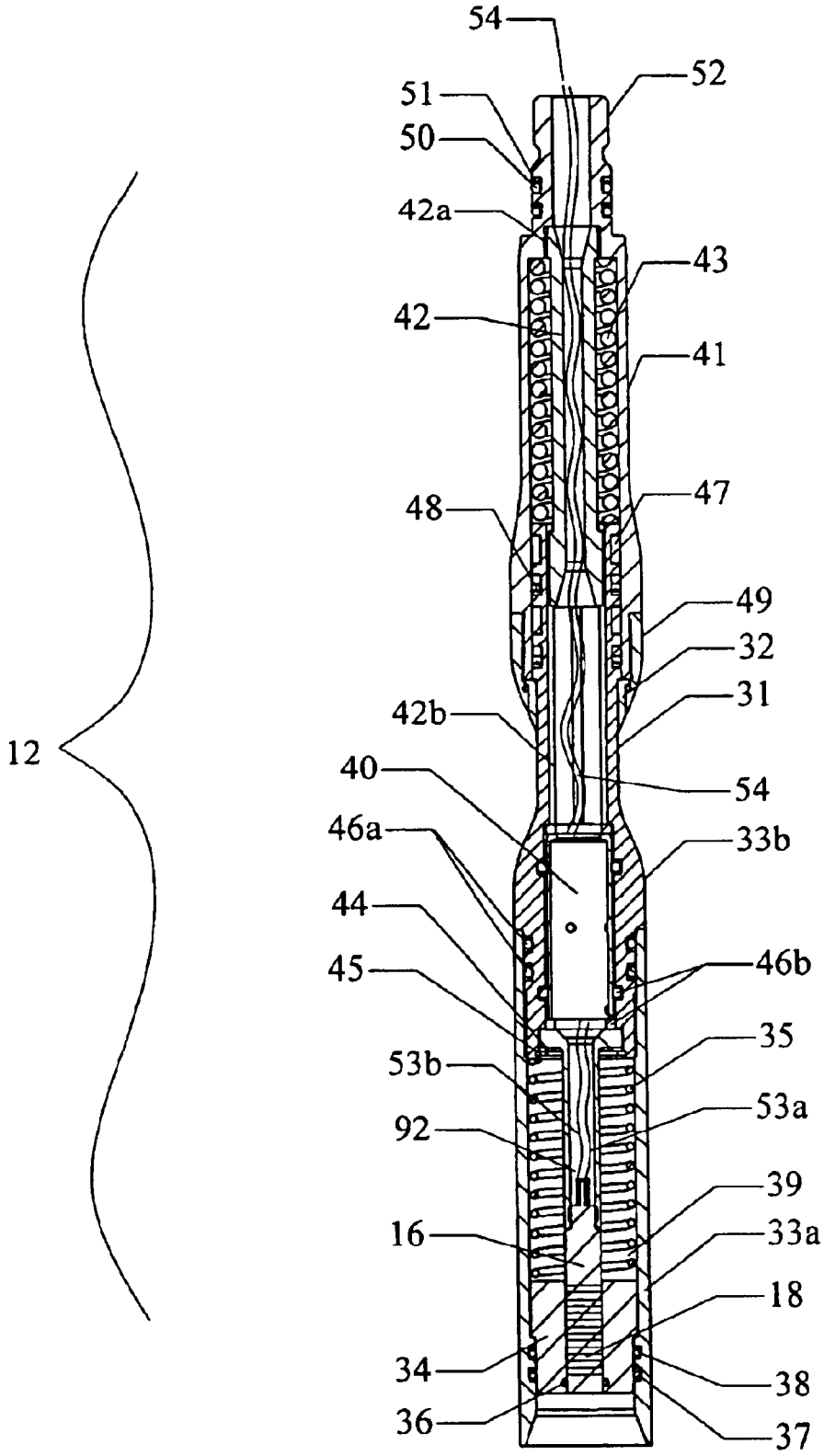
FIG. 2 shows an enlarged cross section of the plug means and associated pressure housing therefore shown in FIG. 1.

FIG. 2 is an enlarged view of the plug means 12 and male member 16, housed in a pressure housing 33*a,* pressure housing 33*b* and pressure housing 41 all shown in FIG. 1. Male connector 16 and electrical contacts 18 thereon are shrouded by a non-conductive sheath or sleeve 34, which is slidable along male member 16 and biased by compression spring 35 to a position as shown in FIG. 2 covering male member 16 and electrical contacts 18 thereon. Sleeve 34 possesses elastomeric seal 36 adapted to surround male member 16 and to prevent ingress of potentially harmful fluids or gases which might otherwise come into contact with electrical contacts 18 on male member 16. Additional seals 37,38 interposed between pressure housing 33*a* and sleeve 34 prevents ingress of liquids or gases which would otherwise gain access to the plenum 39 rearward of sleeve 34 and thence to electrical contacts 18 on male member 16.

In a preferred embodiment, an electronic switch 40 (identified in FIG. 6 as item 202 for the purposes as explained later herein) is contained within the pressure housing 33*b*. A further pressure housing 41 is provided, slidably mounted on a portion of pressure housing 33*b*, as shown in FIG. 2. Such pressure housing 41 is adapted to be fixedly mounted to an interior of drill pipe 28, as shown in FIG. 1. Pressure housing 41 contains a compression spring 43 of much higher stiffness relative to the compression spring 35 and which, when such plug means 12 and pressure housings 33*a, b* and 41 are situated in the interior of a drill pipe 28 as shown in FIG. 1 and matingly engaged with a socket means 14 and associated pressure housing 15, is adapted to bias pressure housings 33*a,b* in contact with pressure housing 15 so as to form a slidable assembly 10 and assist in maintaining the socket means 14 and associated receptacle means 20 in mating engagement with the plug means 12 and male member 16 during high axial shocks, typical of the drilling environment.

While pressure housing 15 and associated socket means 14 may rotate relative to plug means 12 and associated housing 33*a,b,* relative rotation between the pressure housings 33*a,b* and 41 is prevented with a splined, anti-rotation sleeve 42, which is fixed at a first location 42*a* to pressure housing 41, and splined at a second location 42*b* to pressure housing 33*b*. The heavy compression spring 43 allows the slidable assembly to compensate for axial mis-alignment of the two pressure housings 33*a,b* and 15. Axial mis-alignment may be of some reasonable amount, within a quarter of an inch, for instance, which results when the socket means 14 and associated drill pipe 26 is mated to plug means 12 and associated drill pipe 28. (see FIG. 4)

The male member 16 mounts to plug means 12 via mounting rod 43, which is held in place by a washer 44 and a snap ring 45 (See FIG. 2). The mounting rod 92 and electronic switch 40 are supported by impact-absorbing, elastomeric washers 46*a, b*. O-ring 46*a* seals pressure housing 33*a* to pressure housing 33*b*. Pressure housing 33*b,* in a reduced area portion 31, is slidably mounted within pressure housing 41 (see FIG. 2). Pressure housing 41, in order to permit that portion of pressure housing 33*b* to be slidably mounted within it, is lined with sliding bearings 47 and elastomeric seals 48. Pressure housing 33*b,* at least in its reduced area portion which is slidably mounted in pressure housing 41, is retained and is held inside pressure housing 33*b* with two split bushings 32 and a threaded cap 49. O-rings 50 and back-up rings 51 in conjunction with thread 52 allow a sealed connection between that portion of pressure housing 33*b* and pressure housing 41. Such scaling permits pressure housing 41 to further contain therewithin, or further upwell therefrom additional sensors, telemetry modules, power supplies, or other electrical equipment. Insulated wires 53*a, b* from the end of the male member 16 pass through the mounting rod 92, and attach to switching electronic switch 40. The switched lines 54 are then carried through pressure housing 33*b,* anti-rotation sleeve 42, and pressure housing 41 to aforementioned electrical equipment located up-well.

Figure 3:
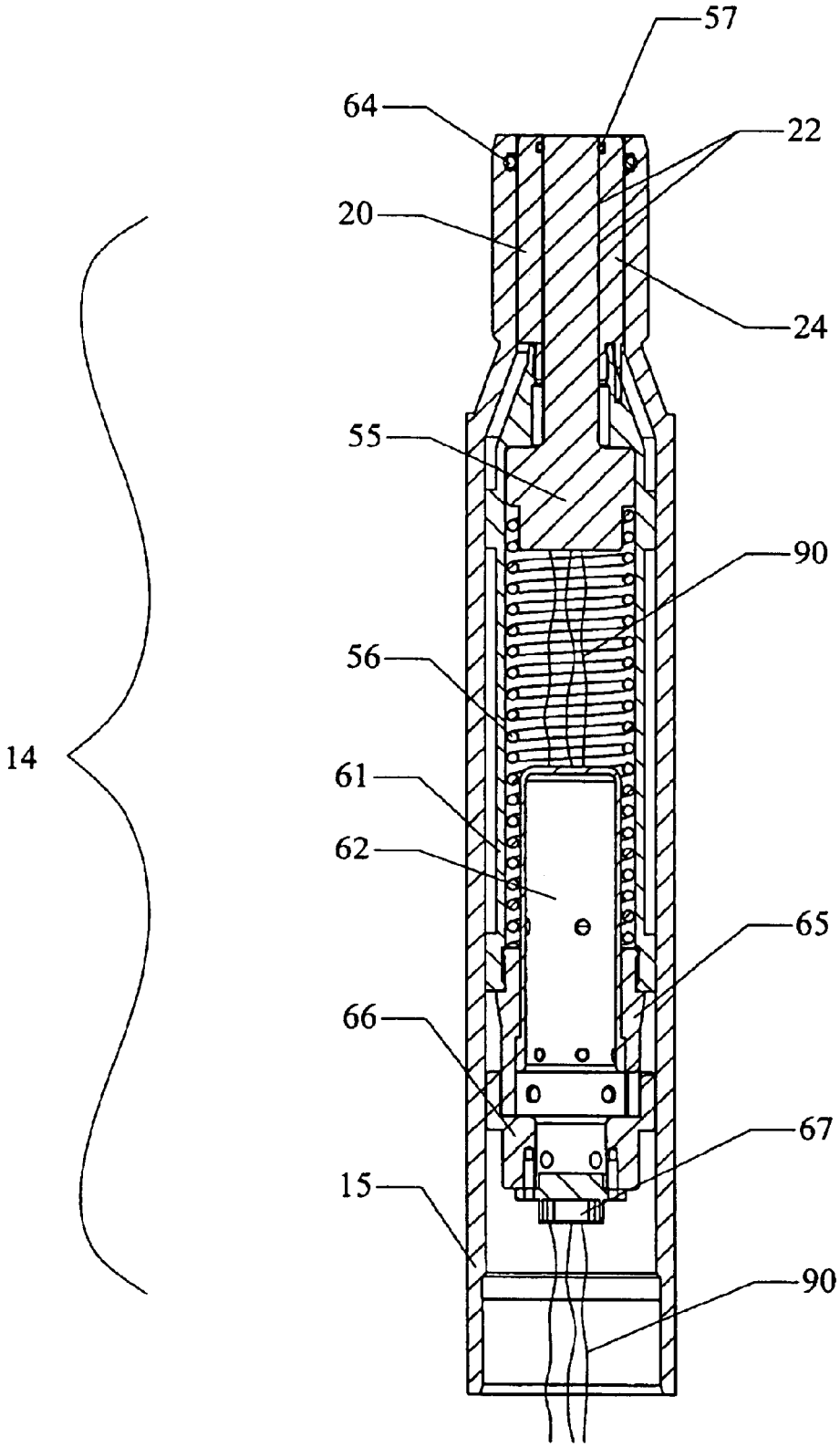
FIG. 3 shows an enlarged cross section of the socket means and associated pressure housing therefore shown in FIG. 1.

FIG. 3 shows a cross section of socket means 14, pressure housing 15, and receptacle 20. Receptacle 20, when not engaged by male member 16, possesses therewithin a slidable piston 55 as shown in FIG. 3, which is resiliently biased into said receptacle 20 by compression spring 56. Seal 57 within receptacle 20 operates in conjunction with slidable, non-conductive piston 55 to sealingly protect receptacle 20 from ingress of dirt or other foreign material, which may otherwise harm or prevent good electrical connection being made between circumferential electrical contacts 22 disposed about an inner periphery 24 of receptacle 20, and electrical contacts 18 disposed about outer periphery of male member 16 when such male member 16 is placed in receptacle 20 during mating engagement of plug means 12 with socket means 14 during mating engagement of the two drill pipes 26,28.

Outer pressure housing 15 houses an inner housing 61, which encloses compression spring 56, non-conductive piston 55, and an electronics carrier 62. Electronics carrier 62 may contain such things as a battery power supply and/or radio frequency transmitter, and/or one or more sensors, all of which are typically located in downhole members such as aforesaid drill pipe 26, and which require electrical connection via plug means 12 and wires 52*a, b* to up-well electronic equipment.

Receptacle 20 mounts onto the end of an inner housing 61. An elastomeric shock absorber/seal 64 is mounted between at the interface between the inner surface of pressure housing 15 and the outer periphery of the receptacle 20 to prevent contaminents and foreign matter from entering pressure housing 15 and inner housing 61. A threaded mount 65 supports electronics carrier 62 and retains the compression spring 56. A coupling 66 in turn supports threaded mount 65, and permits passage of wires 90 from electronics carrier 62 down-pipe within pipe 26. An off-the-shelf electrical connector 67, such as an ITT-Canon MDM connector, mounts on the coupling 66 to provide electrical connection to the down-pipe mating components, which may consist of additional sensors, telemetry modules, power supplies, or other electrical equipment (not shown).

Figure 4:
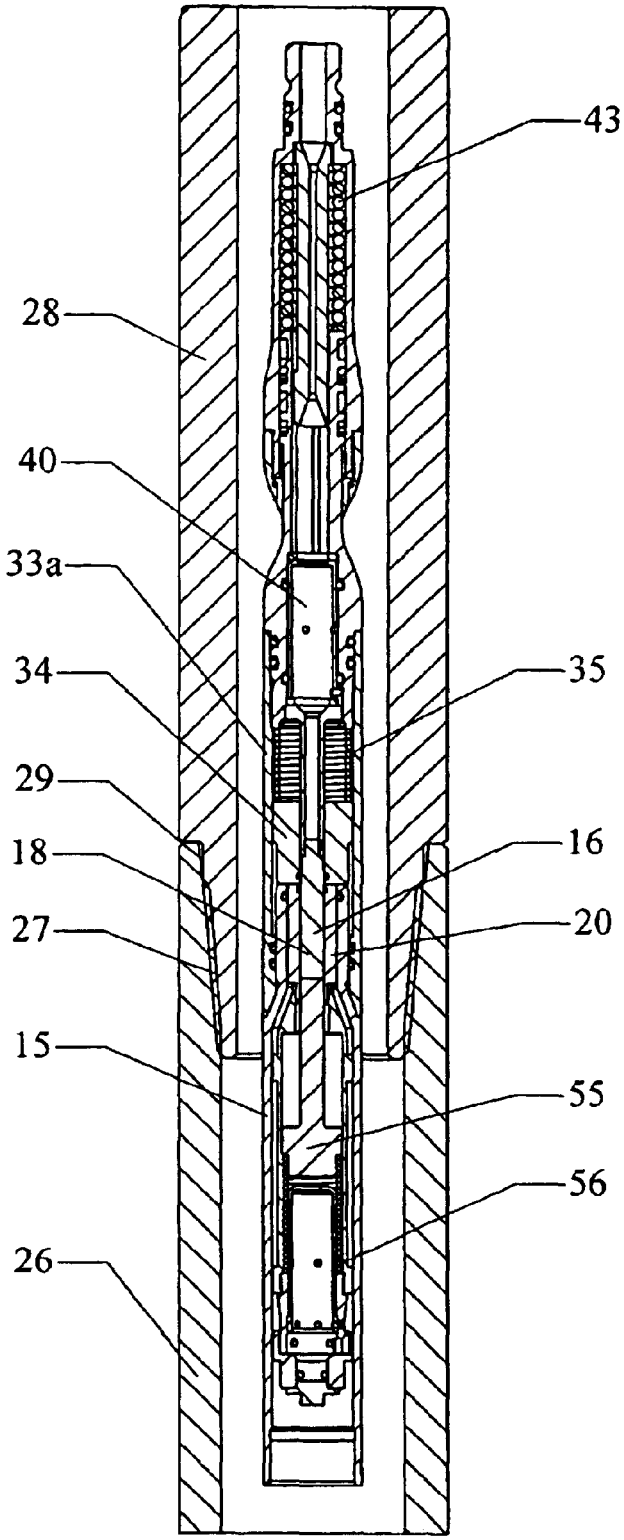
FIG. 4 is a cross section of the two drill pipe members in mated threadably-engaged position, showing the electrical contacts and pressure housings also mated.

As may be seen from FIG. 4, during mating engagement of drill pipe 26 with drill pipe 28, wherein the male end 29 of drill pipe 28 is threadably inserted in the female end 27 on drill pipe 26, such results in rotating and helical travel of male member 16 into the female receptacle 20. Slidable piston 55 is slidably displaced from within receptacle 20 by the insertion of male member 16. Simultaneously, sleeve 34 is slidably displaced from covering male member 16 upon socket means 14, and in particular receptacle 20, coming into contact with plug means 12 and in particular sleeve 34. The leading faces of the receptacle 20 and male member 16 push on sleeve 34 and piston 55, respectively, causing them to slidably retract against the spring force exerted by springs 56 and 35, respectively. In a preferred embodiment, as the electrical conductors 18 on male member 16 slide past the circumferential contacts within receptacle 20 remain switched off (ie electrically isolated) by means of an electrical switch 40, as more fully described below. The electrical switch 40 only connects the electrical contacts of the receptacle 20 and/or the male member 16 to electrical power only when male member 16 is substantially inserted within receptacle 20 and after the electrical contacts 18, 22 are each in the desired and intended alignment.

Advantageously, as the joining of the drill pipe 26, 28 continues past the full mating of the plug means 12 and socket means 14, namely past the full mating engagement of male member 16 within receptacle 20, additional axial travel compresses the stiffer compression spring 43. Spring 43 provides continual clamping force on the plug 12 and socket 14 means while allowing for variation in the threaded length of the joining members, namely drill pipes 26 and 28.

Figure 5:
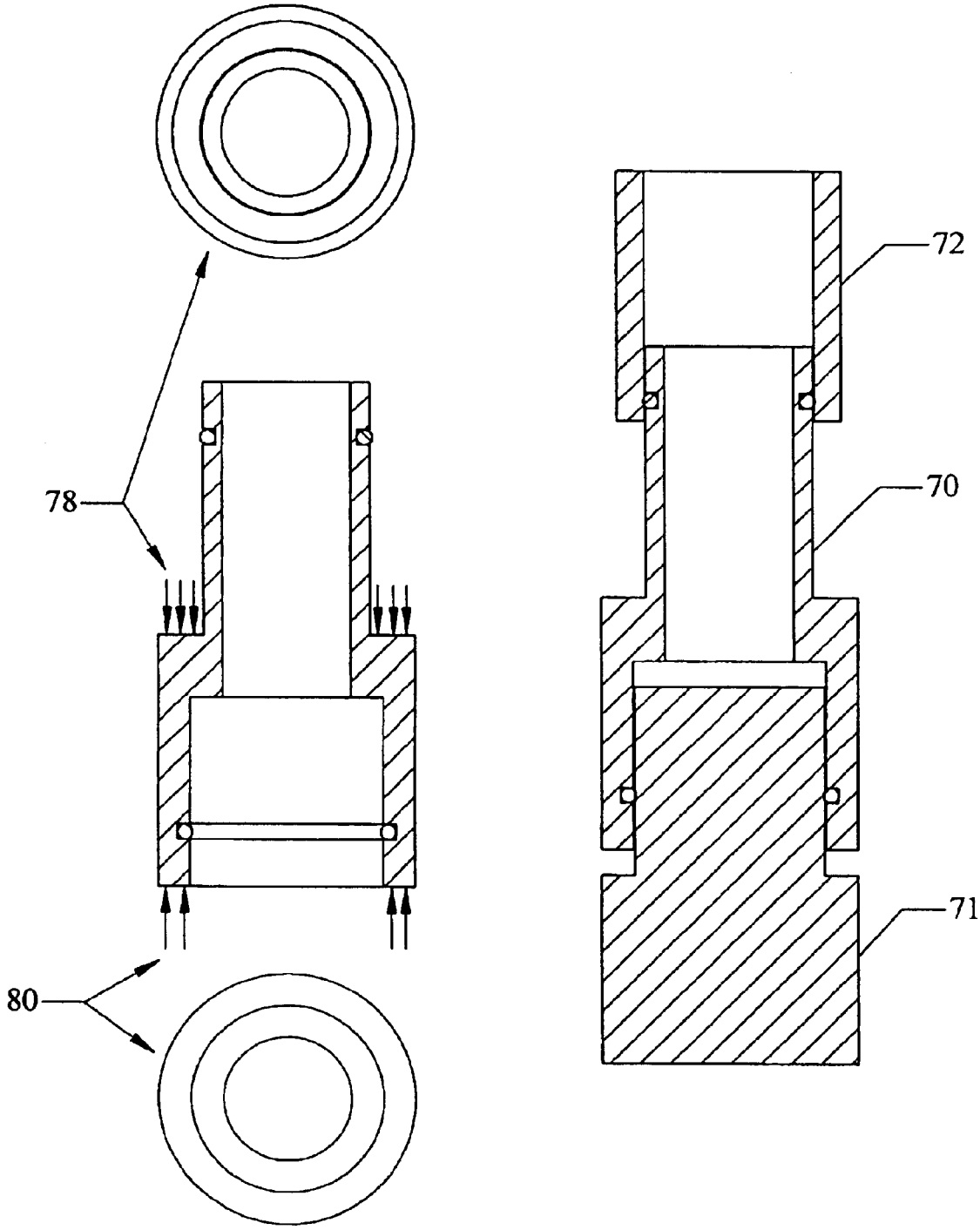
FIG. 5 is a simplified diagram demonstrating the principle of projected surface area.

With reference to FIG. 5, an additional benefit of the invention may be seen when fluid pressure is acting on the exterior of the pressure housings 15, 33*a,b* and 41. When proper consideration of the projected area of the external surfaces of the pressure housings 15 and 33 is made, it is possible to cause the housings 15 and 33*a,b* to be held together by external pressure. The housings 15, 33*a,b* are thus less likely to be affected by shock and vibration, which if allowed to go unchecked may cause separation of the plug 12 and socket 14 means, and eventually an electrical discontinuity.

For the purpose of demonstrating the above principle, a simplified diagram is used as shown in FIG. 5. Slidable member 70 represents pressure housings 33*a,b*. Fixed member 71 represents pressure housing 15, and fixed member 73 represents pressure housing 41. Slidable member 70 is sealed between fixed members 71 and 72. The projected surface area 80 in the axial direction on the first face of slideable member 70 is less than the projected surface area 78 on the second face of slideable member 70. A difference in projected surface area between the first and second face of approximately 1 square inch is easily achieved. Should the external pressure acting on these faces be, for instance, 15,000 psi (pounds per square inch), the clamping force holding slideable member 70 to fixed member 71 due to the external pressure is 15,000 lbs.

Figure 6:
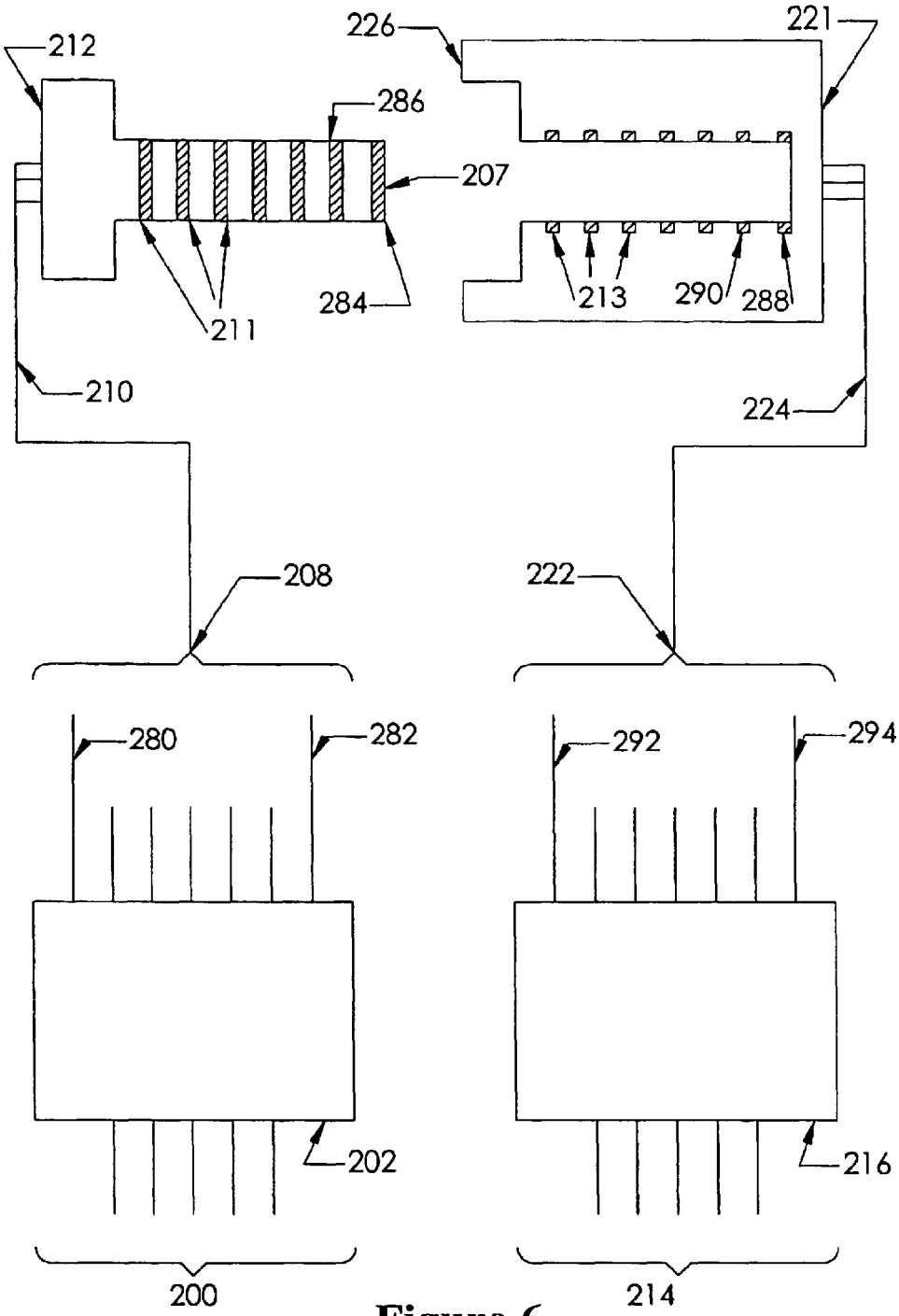
FIG. 6 is a schematic showing a general form of the coaxial plug and socket electrical. connections of the present invention.
Figure 7:
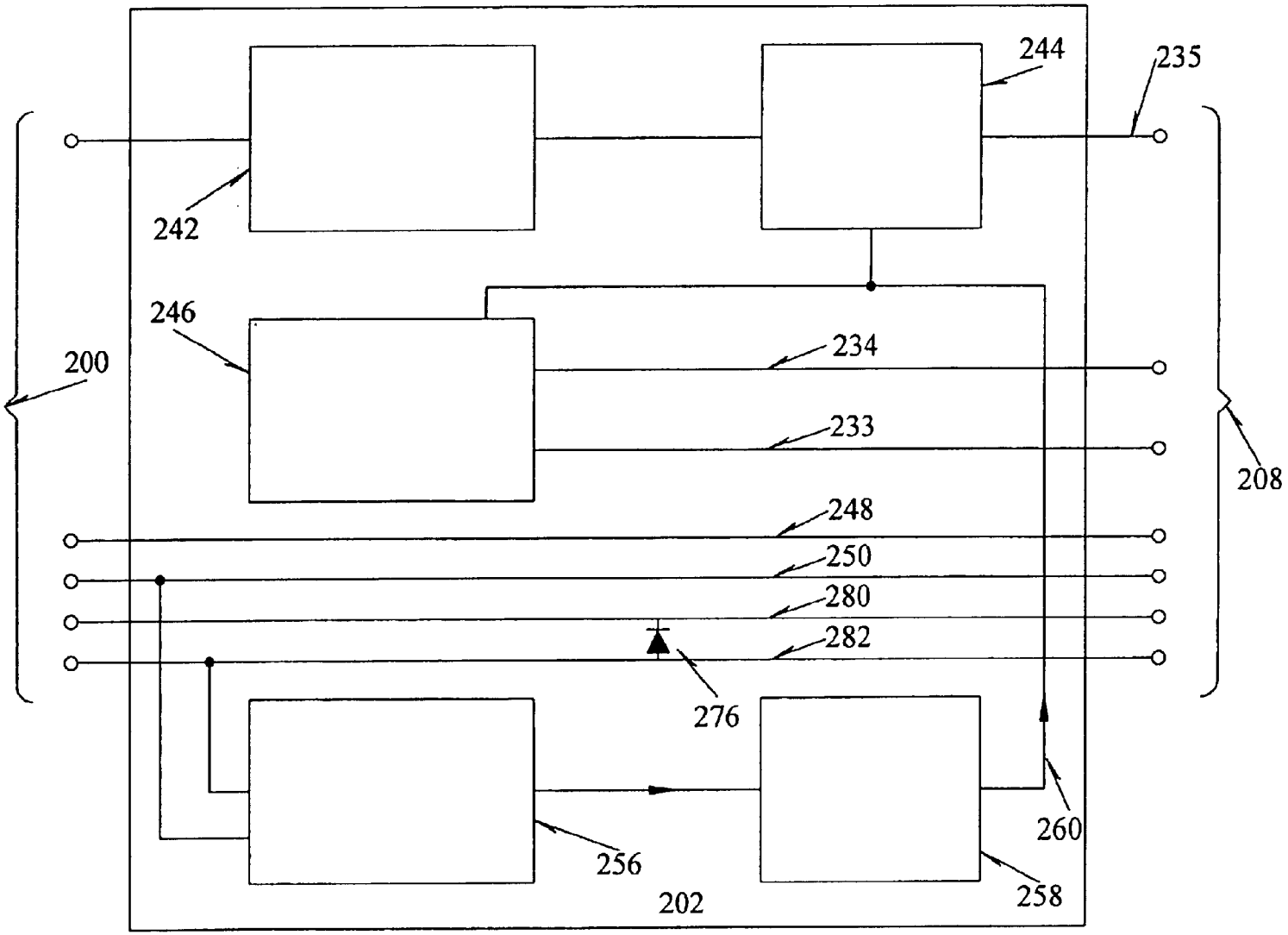
FIG. 7 is a more detailed schematic diagram of isolation circuit for the plug isolation circuit shown in FIG. 6.
Figure 8:
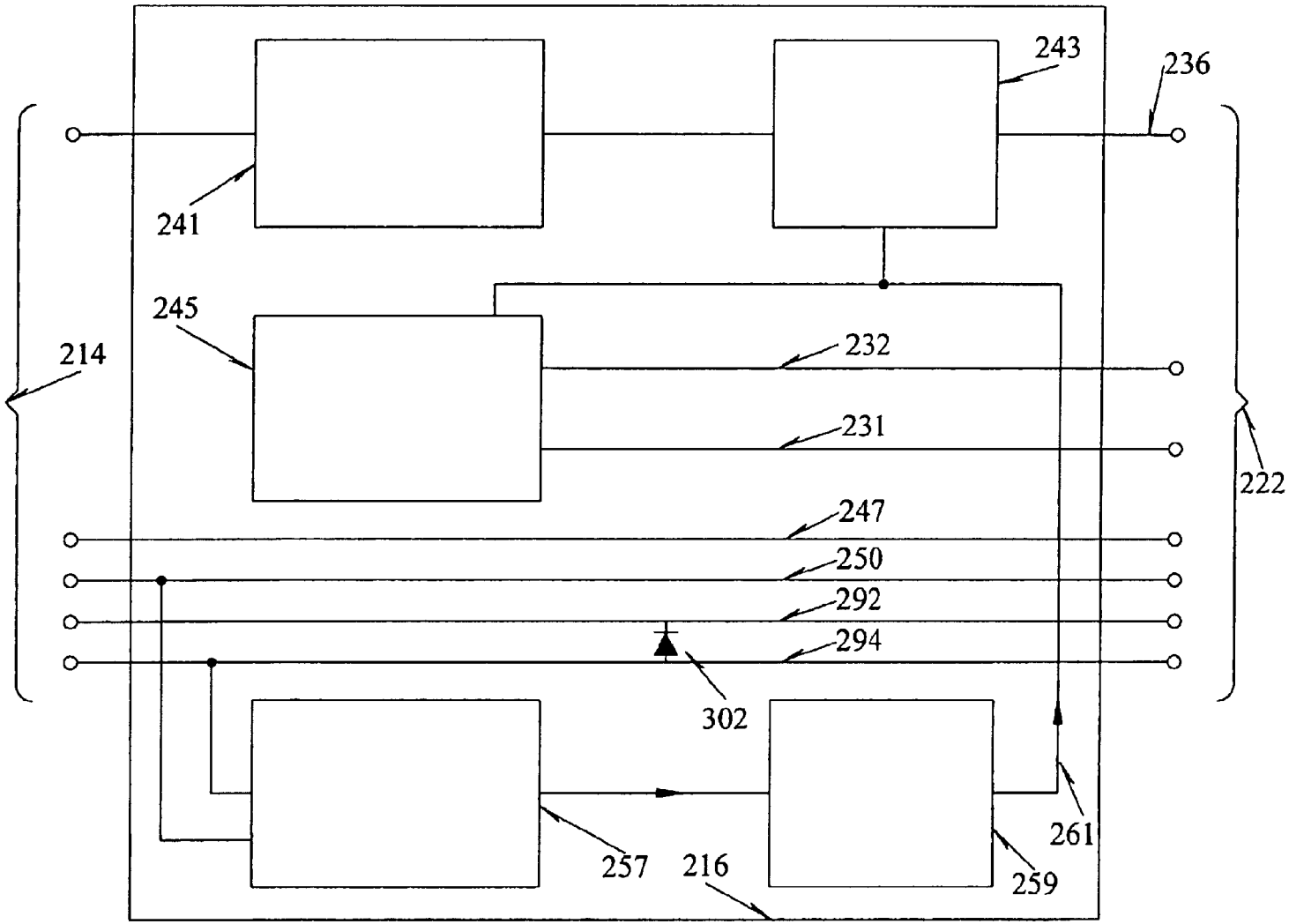
FIG. 8 is a more detailed schematic diagram of the isolation circuit for the socket side isolation circuit shown in FIG. 6.

While there are many methods of connecting two electronic circuits together, in one aspect the invention contemplates use of a coaxial plug and socket pair 212 and 226 respectively, as indicated in FIG. 6, each having a plurality of coaxially situate, concentric electrical contacts 211, 213 respectively thereon. The advantage of using such a coaxial multi-contact system is that the plug 212 and socket 226 can be housed in tubular containers (eg. pressure housings 15 and 33*a, b*) and the housings matingly engaged such as by screwing them together, thereby engaging the coaxial plug 212 into socket 226. The mechanical advantage of this method of engagement brings a disadvantage—the majority of the contacts 211, 213 wipe past each other during insertion of plug 212 into socket 226 before the plug 212 and socket 226 become fully engaged. This may cause damage to attached electronic components if they are activated by some power source. Accordingly, the invention provides for interposing specific isolation circuits 202 and/or 216 to isolate and protect such components during the engagement process. We accomplish this by connecting plug 212 via wire harness 210 to switching circuit 202. This circuit 202 isolates a variety of input/output lines (I/O) 200 from I/O lines 208. A pair of lines is dedicated to use as sensor lines (Sensor Line 1 204 and Sensor Line 2 206) contacts 286 and 284 which are preferably but not necessarily at the distal end 207 of plug 212. Similarly we connect socket 226 via wire harness 224 to an isolation circuit 216. Circuit 216 isolates a variety of input/output lines (I/O) 214 from I/O lines 222. A pair of lines is dedicated for use as sensor lines (Sensor Line 1 218 and Sensor Line 2 220). For simplicity of deployment we have designed circuit 202 to be identical to circuit 216 (ref. FIGS. 7 & 8), though this feature is not a required aspect of this invention. Although we indicate seven sets of corresponding electrical contacts 211, 213 associated respectively with plug 212 and socket 226, it is obvious that the number of sets of contacts 211 and 213 applicable to this application can be any reasonable number greater than two, and the depiction of seven contacts is merely arbitrary and illustrative of the principals to be employed.

FIG. 7 is a more detailed schematic diagram of the isolation circuit 202 in respect of the plug contacts 211, as shown in FIG. 6. The I/O lines comprise a Power Line 235 monitored by Current Sensor 242 and controlled by Power Switch 244, digital lines 233, 234 controlled by Digital Switches 246, an unswitched line 248, a Ground Line 250, two Sensor Lines 280 and 282 controlled by Sensor Circuit 256 and Timer Circuit 258, the Timer 258 providing an Interrupt Line 260 to control Power Switch 244 and Digital Switches 246.

FIG. 8 is a more detailed schematic diagram of the isolation circuit 216 in respect of the socket contacts 213, as shown in FIG. 6. The I/O lines comprise a Power Line 235 monitored by current sensor 242 and controlled by Power Switch 243, digital lines 232, 232 controlled by digital switches 245, unswitched 248, a ground line 250, two sensor lines 292 and 294 controlled by a sensor circuit 257 and Timer Circuit 259, the Timer 259 providing an Interrupt Line 260 to control Power Switch 243 and digital switches 243.

Figure 9:
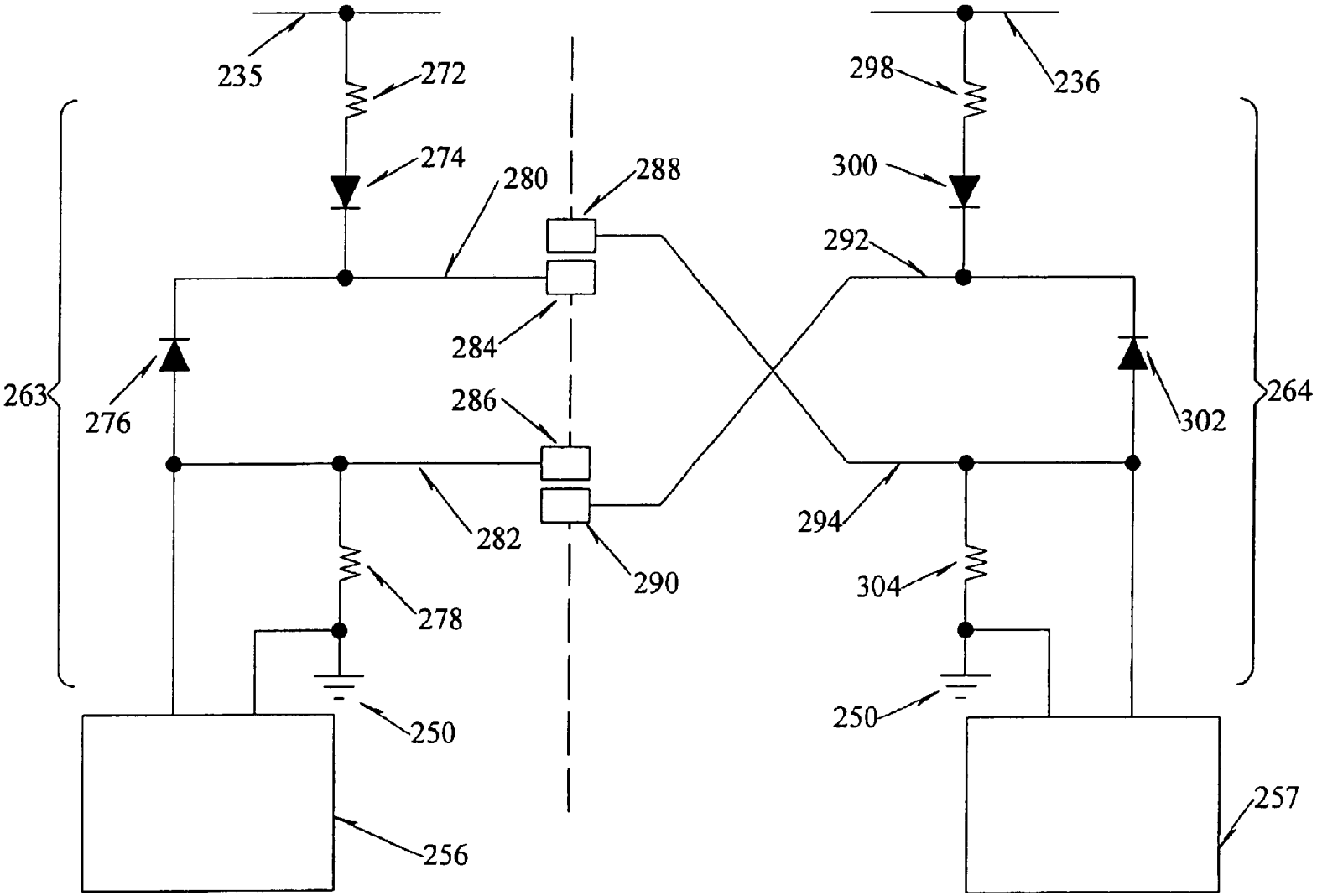
FIG. 9 shows schematically a sensor circuit of the type used in the isolation circuits shown in FIG. 6, where both plug and socket have associated circuits and are each electrically powered.

FIG. 9 shows plug sensor circuit 256 and socket sensor circuit 257 shown generally in FIGS. 7 & 8 respectively and how the sensor lines 292, 294 and 280, 282 are activated only by the full engagement of the plug 212 and socket 226. A positive potential +V on the plug sensor circuit side 256 is connected to a resistor R1 272, then to a forward-biased diode 274, then to diode 276 that acts to block this current, and finally to another resistor 278. Sensor Line 1 (280) is connected at the junction of 274 and 276 to plug contact 284. Sensor line 2 (282) is connected at the junction of 276 and 278 to plug contact 286 and also to the plug sensor circuit 256 output. Similarly, a positive potential +V on the socket circuit side 257 is connected to a resistor R1 298, then to a forward biased diode 300 then to a diode 302 that acts to block this current, and finally to another resistor 304. Sensor Line 1 292 is connected at the junction of 300 and 302 to socket contact 290. Sensor line 2 (294) is connected at the junction of 302 and 304 to plug contact 288 and also to the socket sensor circuit 257 output.

Figure 10:
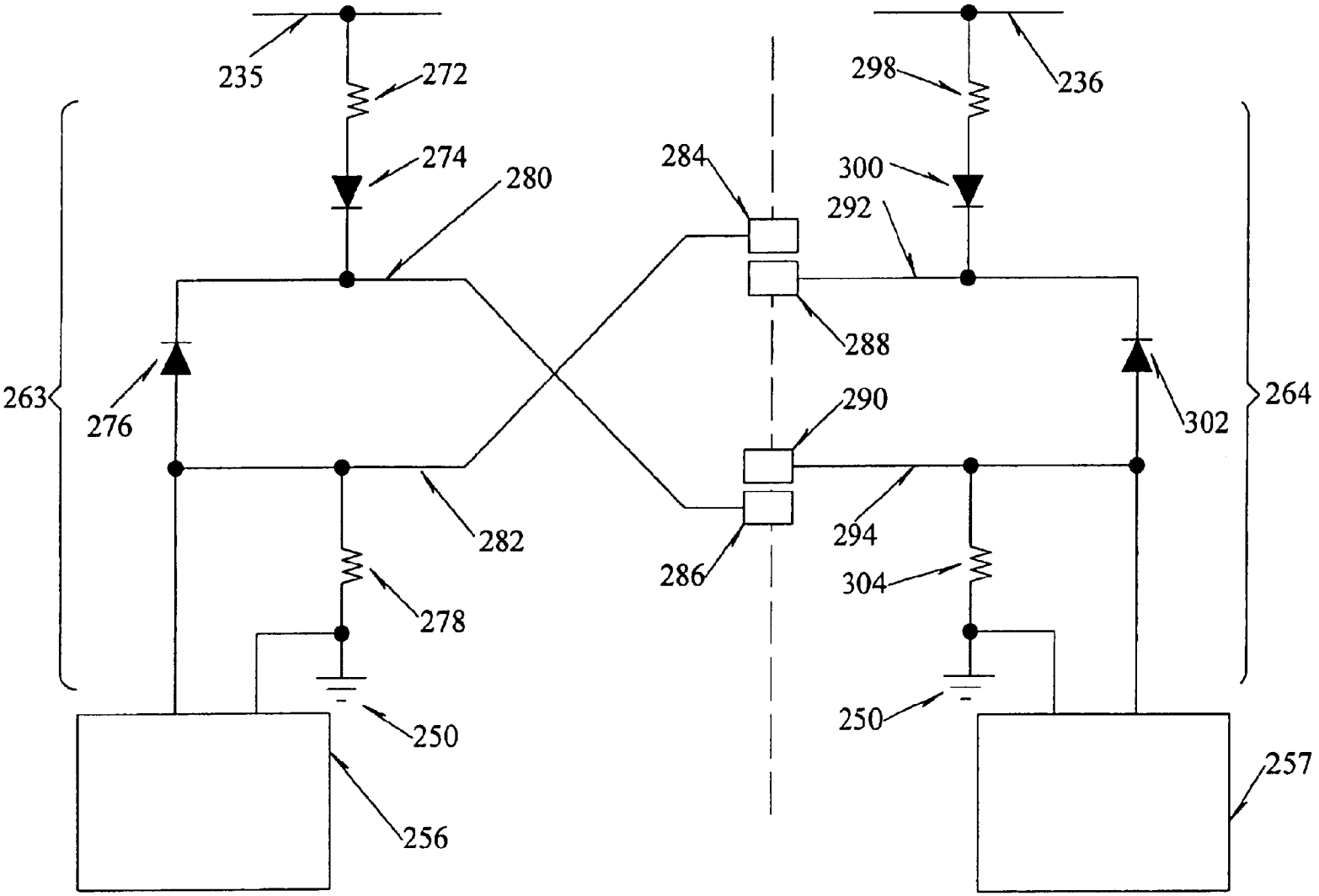
FIG. 10 is a sensor circuit similar to that shown in FIG. 9, but modified slightly to form an alternate embodiment.

It will be noted that the sensor lines 292, 294 on the socket sensor circuit 257 are crossed with respect to the sensor lines 280, 282 on the plug circuit 256; apart from this circuits and wiring for both plug and socket sensor circuits 256, 257 are identical. The plug-side and socket side sensor circuits 256, 257 may alternatively be arranged as shown in FIG. 10, wherein sensor lines 280, 282 are crossed with respect to sensor lines 292, 294.

To clarify how the units sense that the plug/socket combination has achieved full engagement, we proceed by explaining various embodiments.

Embodiment 1

Figure 11:
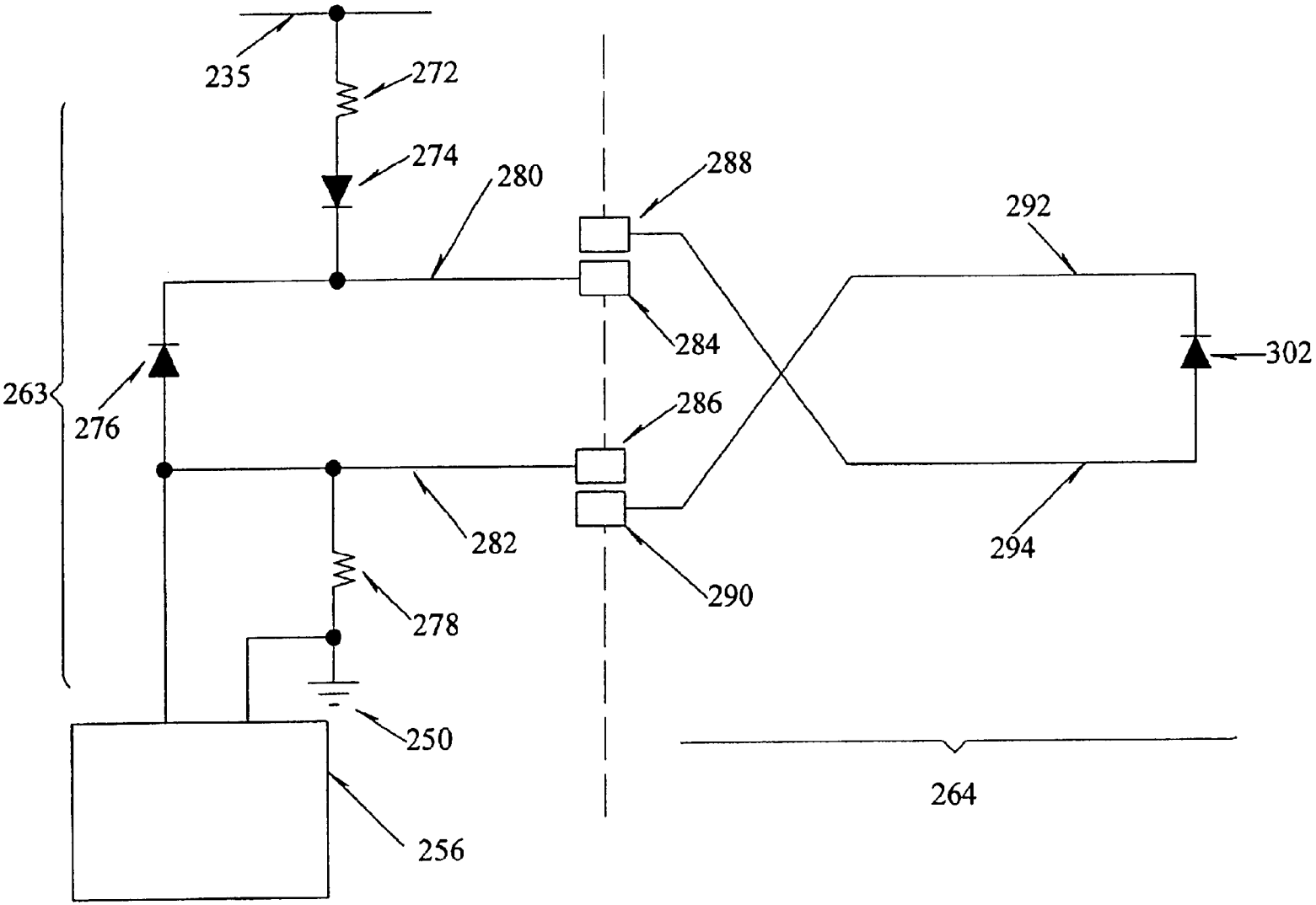
FIG. 11 shows schematically a sensor circuit, where only the plug side has associated isolation circuits and is electrically powered.

FIG. 11 denotes an arrangement where active powered electronic circuits are incorporated only on the plug side, and electronic access to the plug side circuits does not require socket side isolation circuitry, the socket side being essentially passive. For illustrative purposes we set the power line +V at 15 volts, resistor R1 272 is 50,000 ohms and resistor R2 278 is 100,000 ohms.

As may be seen with reference to FIG. 11, the determination of the full engagement of plug 212 and socket 216

Figure 13:
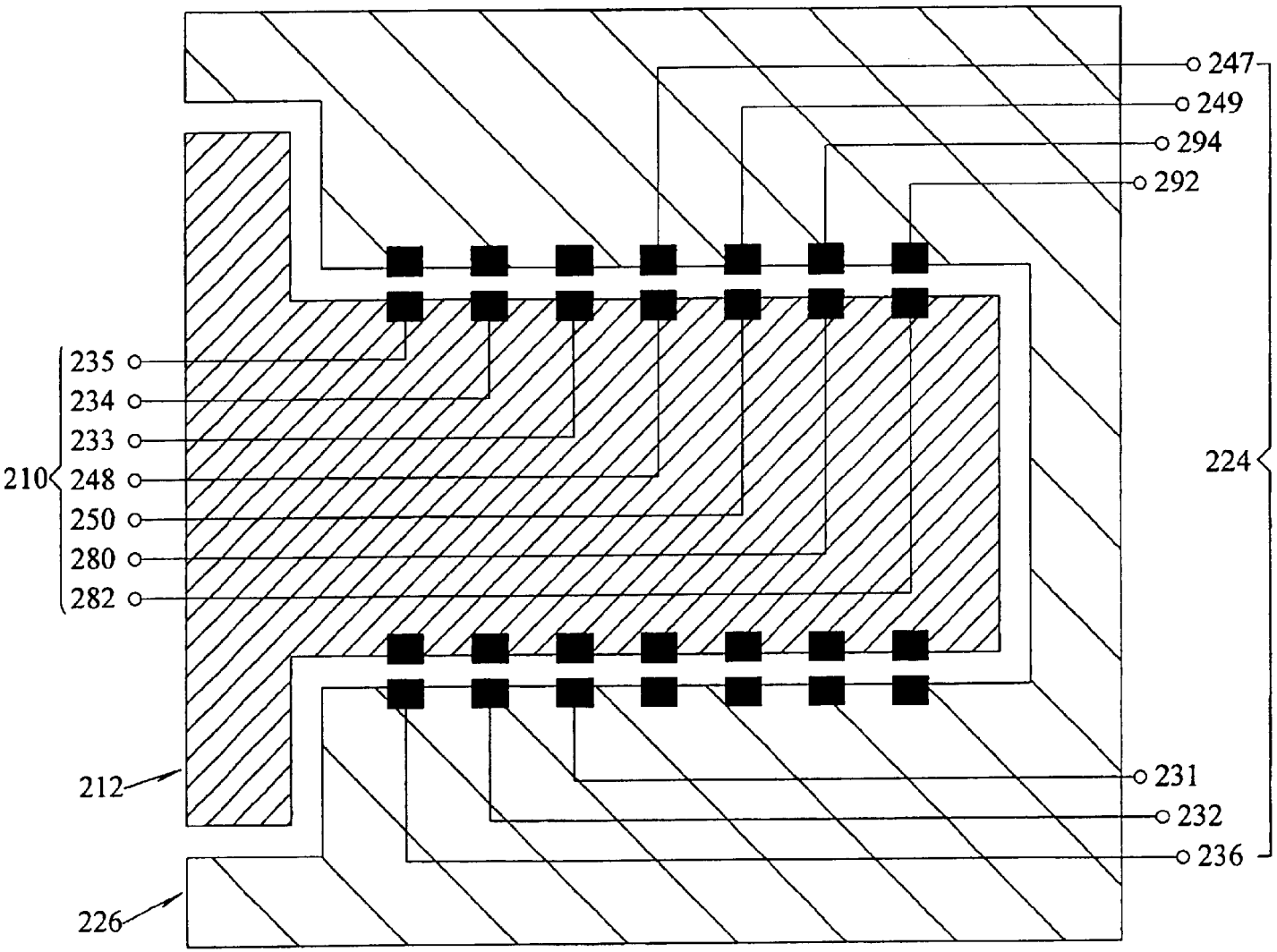
FIG. 13 is a schematic drawing showing a typical plug and socket connector which may be used in the present invention, further showing wiring connections which correspond to the associated wiring of the respective plug and socket electrical isolation circuits where the plug side only has electrical circuits which require isolation.

(whereby electronic circuitry which requires isolation occurs on the plug side) is achieved as follows. Current from supply line 235 flows through resistor R1 (272), through forward-biased diode 274 and is blocked from the plug sensor circuit output by diode 276. A current pathway is available across the plug/socket junctions 284 and 288, through diode 302 that now acts as a sensor diode, back through plug/socket junctions 290 and 286, and finally through resistor R2 (278) to Ground 250. The potential across resistor 278 is sensed by the plug Sensor Circuit 256 to be approximately ⅔ times 15V (set by the potential divider R1/R2 i.e. ~10V. This value is chosen to be comfortably greater than a threshold voltage input to the plug Sensor Circuit 256. Diode 302 is forward biased because of the crossed sensor lines 292 and 294 on the socket side. Were this not the case the required voltage potential at the plug sensor circuit 256 would not be available. Thus only when plug 212 and socket 216 are fully engaged is the plug sensor circuit 256 activated and the remaining switched lines 233, 234 (ref. FIG. 13) connected to corresponding plug contacts 211 then available at the plug electrically powered for use by the circuit(s) attached to the socket 216.

It will be obvious to one reasonably skilled in the art that there should be no electrical circuits associated with socket 226 such as digital switches 245 that are in electrical communication with any of the non-sensor contacts 213 that would be electrically mistaken for the action of diode 302, so as to otherwise initiate a "triggering" of the power switch 244. To further guard against such a possibility, in a preferred embodiment of this aspect of the invention the output of sensor circuit 256 in respect of the plug sensor circuitry is passed through timer 259 (FIG. 7). The function of timer circuit 259 is to delay activation of Interrupt Line 260 controlling Power Switch 244 and Digital Switches 246 (ref. FIG. 7 ) until the full engagement of plug 212 and socket 226 can be reasonably expected (typically one to two minutes).

The only significant requirements on the passive socket side is a diode 302 that is forward biased by crossed sensor lines 292, 294 in order that the sensed circuit 256 is correctly activated.

Embodiment 2

Figure 12:
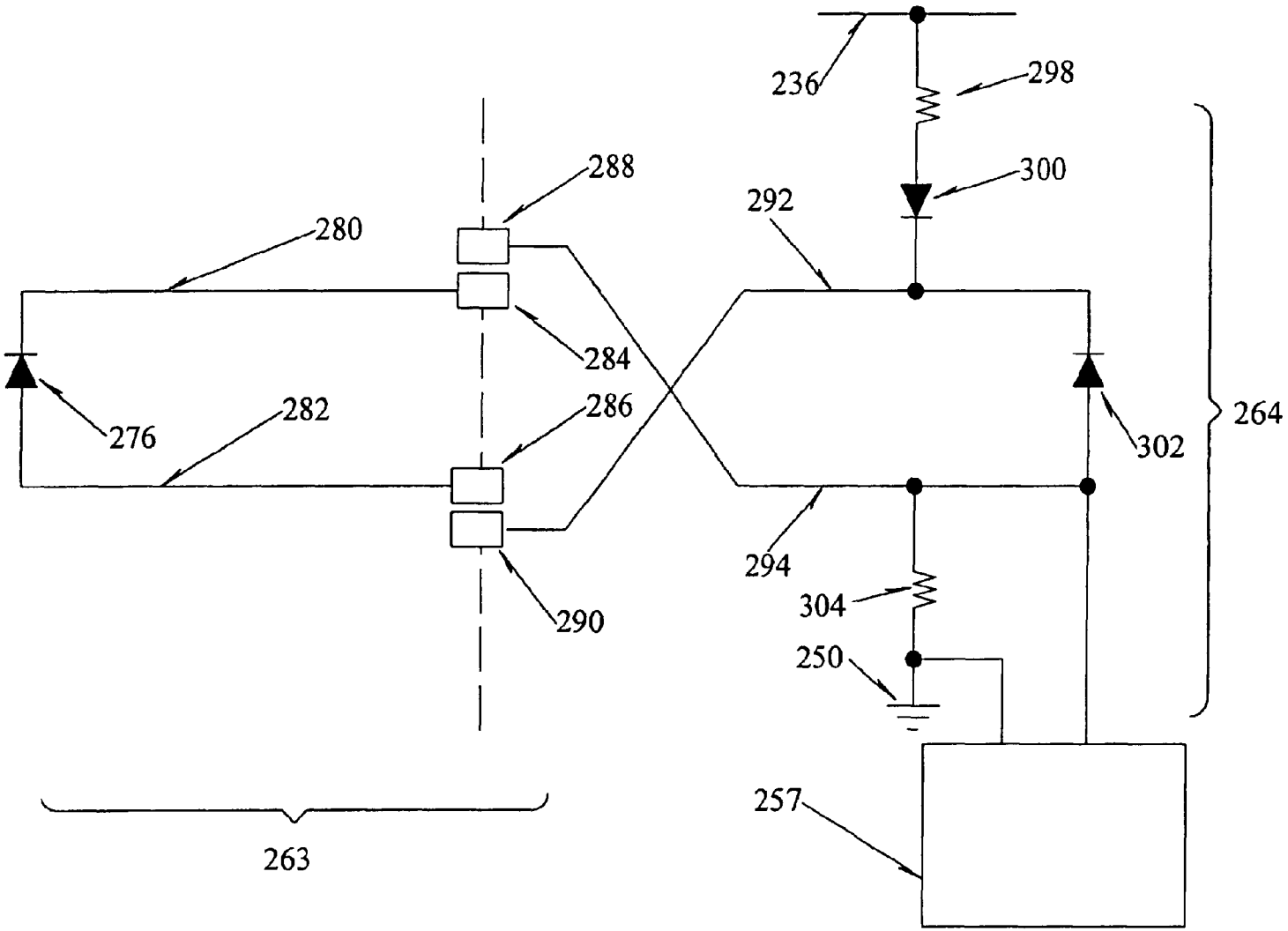
FIG. 12 shows schematically a sensor circuit, where only the socket side has associated circuits and is electrically powered.

The complementary circuit of Embodiment 1 is depicted in FIG. 12 and denotes an arrangement where active powered electronic circuits are incorporated only on the socket side, and furthermore that electronic access to the socket side circuits does not require plug side isolation circuitry because the plug side is essentially passive. For illustrative purposes we set the power line +V at 15 volts, resistor R1(298) is 50,000 ohms and resistor R2 (304) is 100,000 ohms.

As may be seen with reference to FIG. 12, the determination of the full engagement of plug 212 and socket 216 (whereby electronic circuitry which requires isolation occurs on the plug side) is achieved as follows. Current from supply line 236 flows through resistor R1 (298), through forward-biased diode 300 and is blocked from the plug sensor circuit output by diode 302. A current pathway is available across the plug/socket junctions 290 and 286, through diode 276 that now acts as a sensor activation element by passing current back through plug/socket junctions 284 and 288, and finally through resistor R2 (304) to Ground 250. The potential across resistor R2 (304) with respect to Ground 250 is sensed by the socket Sensor Circuit 257 to be approximately ⅔ times 15V (set by the potential divider R1/R2 i.e. ~10V.) The threshold voltage necessary to activate the socket Sensor Circuit (257) could be set at 6 or 7 volts, greater than typical logic levels of 5V. Thus the activation voltage of ~10V is comfortably greater than the threshold, and false activations are minimized. Diode 276 is forwarded biased because of the crossed Sensor Lines 292 and 294 on the socket side. Were this not the case the required voltage potential at the socket Sensor Circuit 257 would not be available because no current could flow through resistor R2(304), causing the appropriate activating voltage to be absent. Thus only when plug 212 and socket 216 are fully engaged is the socket Sensor Circuit 257 activated, and the switched lines forming part of the I/O bus 214 are then electrically connected to the I/O bus 222. Hence the switched (and also the unswitched) lines are correctly available at the socket via the fully engaged plug.

It will be obvious to one reasonably skilled in the art that there should be no electrical circuits associated with plug 216 such a Digital Switches 246 that are in electrical communication with any of the non-sensor contacts 213 that would be electrically mistaken for the action of diode 276, so as to otherwise initiate a "triggering" of the Power Switch 243. To further guard against such a possibility, in a preferred embodiment of this aspect of the invention the output of Sensor Circuit 257 in respect of the socket sensor circuitry is passed through Timer Circuit 259 (ref. FIG. 8). The function of Timer Circuit 259 is to delay activation of Interrupt Line 261 controlling power Switch 243 and Digital Switches 245 until the full engagement of plug 212 and socket 226 can be reasonably expected (typically one to two minutes).

The only significant requirements on the passive plug side is a diode 276 that is forwarded biased by crossed sensor lines 292, 294 in order that the Sensor Circuit 257 is correctly activated.

Embodiment 3

The discussion of Embodiment 1 and Embodiment 2 above now makes the understanding of Embodiment 3 as exemplified by FIG. 9 straightforward. Both plug sensor circuit 256 and socket sensor circuits 257 are powered independently by +V(plug) 235 and +V(socket) 236. The voltage potential at Sensor Circuit 256 (plug) output is available in either of two routes:

a) current from line 235 via resistor R1(272) and diode 274 passes along sensor line 1 (280) to contacts 284 and 288, then via sensor line 2 (294) through diode 302, Sensor Line 1 (292), contacts 290 and 286; or b) current from line 236 through resistor R1 (298) and diode 300, along Sensor Line 1 (292), through from contacts 290 and 286 to sensor line (282).

The choice of routes a) or b) is determined solely by whether +V(plug) 235 is greater than +V(socket) 236 by more than one diode drop (typically 0.6V). In either case the significant issue is that the plug Sensor Circuit 256 is activated by an adequate +V(socket) 235 potential or by the presence of diode 300—both are associated with the full engagement of the plug and socket, and either will suffice.

Likewise, the potential at sensor circuit 257 (socket) is available in either of two means:

c) current from line 236 via resistor R1 (298) and diode 300 passes along sensor line 1 (292) to contacts 290 and 286, then via Sensor Line 2 (282) through diode 276, sensor line 1 (280), and contacts 284 and 288; or d) current from line 235 through resistor R1 (272) and diode 274, along sensor line 1 (280), through from contacts 284 and 288 to sensor line 2 (294).

The choice of routes c) or d) is determined solely by whether +V(socket) 236 is greater than +V(plug) 235 by more than one diode drop (typically 0.6V). In either case the significant issue is that the plug Sensor Circuit 256 is activated by an adequate +V(plug) 235 potential or by the presence of diode 276—both are associated with the full engagement of the plug arid socket, and either will suffice. Diodes 274 and 300 ensure that there can be no unintended reverse flow into their associated power supplies.

This embodiment illustrates usefulness of the symmetry of the circuit operations attached to either plug or socket—fabrication of the switching circuits is simplified in that both assemblies can be identical. The only necessary modification is that the lines must be crossed between contacts 288, 290 and sensor lines 292 and 294.

With reference to the embodiment shown in FIG. 11, it is clearly apparent to a person reasonably skilled in the art that the sensing of full engagement of the plus 212 and socket 226 is facilitated by presence diode 276 in the case of the sensor circuit 256. With reference to the embodiment shown in FIG. 12, it is likewise apparent that the sensing of full engagement is facilitated by the presence of diode 302.

From FIG. 11 it may be clearly seen that where there is electrical circuitry on digital lines 231, 232 and 233, 234 that require isolation to prevent damage, it is apparent that the sensing of full engagement of the plug 212 and socket 226 is facilitated by the inclusion of a diode 302 and 276 on each side of the multi-point connectors 284/288 and 286/290. [It is noted that in such a case, both the plug 212 and socket 226 would need 10 contacts and not 7 (i.e. ground line 250, 284/288, 290/286, separate switched power connections 235 and 236, switched digital lines 231, 232, 233 and 234, and the unswitched line 248.)

Importantly, with respect to each of the embodiments shown in FIGS. 11, 12, & 13, the present invention is not limited to a sensory circuit using only a simple diode as a sensing means. In particular, it is possible and is contemplated within the scope of the present invention to replace each diode 276 and/or 302 by other electrical circuitry, including current direction-limiting circuitry, so as to permit the sensor circuit to produce a particular electronic signal when specifically sensed at full engagement of the plug 212 and socket 226. The present invention is not to be limited to circuitry implementing only diodes 276 and 302.

Although the disclosure described and illustrates preferred embodiments of the invention, it is to be understood that the invention is not limited to these particular embodiments. Many variations and modifications will now occur to those skilled in the art. For definition of the invention, reference is to be made to the appended claims.

We claim:

1. Plug and socket means adapted for mating engagement, for establishing electrical communication therebetween in a hazardous environment;

said plug means comprising:

a) an elongate male member, having a plurality of electrical contacts about an outer periphery thereof;

b) a resiliently-biased sheath member, slidably biased over said male member so as to substantially cover said electrical contacts on said male member, which upon application of force thereto is slidably moveable so as to uncover said electrical contacts; and c) biasing means for biasing said slidable sheath member over said male member;

said socket means comprising:

a) elongate receptacle means having disposed about an inner periphery thereof a plurality of electrical contacts, said electrical contacts adapted to contact said electrical contacts respectively on said male member when said male member is inserted in said receptacle means;

b) resiliently-biased protective means displaceable from said receptacle means so as to permit insertion of said male member within said receptacle means; and c) biasing means, biasing said protective means so as to prevent ingress of any foreign material into said receptacle means when said male member is not yet inserted in said receptacle means;

wherein said male member is adapted for insertion in said receptacle means upon mating engagement of said plug means with said socket means; and wherein said plug and socket means are each rotatable relative to each other.

2. The plug and socket means as claimed in claim 1, said resiliently-biased protective means comprising a piston member, slidably-biased within said receptacle means, adapted to substantially cover said electrical contacts disposed on said inner periphery of said receptacle means when said male member is not yet inserted in said receptacle means.

3. The plug and socket means as claimed in claim 2, wherein said piston member is displaceable from within said receptacle means by said male member upon insertion of said male member in said receptacle means.

4. The plug and socket means as claimed in claim 1, 2, or 3;

said socket means further comprising means for contacting said sheath member upon mating engagement of said plug means with said socket means, so as to cause said sheath member to be slidably displaced from a position covering said male member as said male member is inserted in said receptacle means.

5. Plug and socket means adapted for mating engagement, for establishing electrical communication therebetween in a hazardous environment;

said plug mean comprising:

a) an elongate male member, having a plurality of electrical contacts about an outer periphery thereof;

b) a resiliently-biased sheath member, slidably biased over said male member so as to substantially cover said electrical contacts on said male member, which upon application of force thereto may be slidably moved so as to uncover said electrical contacts; and c) biasing means for biasing said slidable sheath member over said male said socket means comprising:

a) elongate receptacle means having disposed about an inner periphery thereof a plurality of electrical contacts, said electrical contacts adapted to contact said electrical contacts respectively on said male member when said male member is inserted in said receptacle means;

b) resiliently-biased protective means displaceable from said receptacle means so as to permit insertion of said male member within said receptacle means; and c) biasing means, biasing said protective means so as to prevent ingress of any foreign material into said receptacle means when said male member is not yet inserted in said receptacle means;

wherein said male member is adapted for insertion in said receptacle means upon mating engagement of said plug means with said socket means; and wherein:

said plug means are adapted for positioning within an interior of a first threaded tubular housing proximate an end thereof, said end of said threaded tubular housing adapted for mating engagement with a mating end of another threaded tubular housing, and said socket means adapted for positioning within an interior of said another threaded tubular housing proximate said mating end thereof; and said male member is adapted for insertion in said receptacle means upon said first threaded tubular housing being fitted in mating engagement with said another threaded tubular housing.

6. The plug and socket means as claimed in claim 5, wherein said threaded tubular housing is drill pipe.

7. The plug and socket means as claimed in claim 5, wherein said threaded tubular housing is drill collar.

8. Plug and socket means adapted for mating engagement, for establishing electrical communication therebetween in a hazardous environment;

said plug means comprising:

a) an elongate male member, having a plurality of electrical contacts about an outer periphery thereof;

b) a resiliently-biased sheath member, slidably biased over said male member so as to substantially cover said electrical contacts on said male member, which upon application of force thereto may be slidably moved so as to uncover said electrical contacts; and c) biasing means for biasing said slidable sheath member over said male member;

said socket means comprising:

a) elongate receptacle means having disposed about an inner periphery thereof a plurality of electrical contacts, said electrical contacts adapted to contact said electrical contacts respectively on said male member when said male member is inserted in said receptacle means;

b) resiliently-biased protective means displaceable from said receptacle means so as to permit insertion of said male member within said receptacle means; and c) biasing means, biasing said protective means so as to prevent ingress of any foreign material into said receptacle means when said male member is not yet inserted in said receptacle means;

wherein said male member is adapted for insertion in said receptacle means upon mating engagement of said plug means with said socket means;

said plurality of electrical contacts disposed about said periphery of said male member comprising first and second plug contacts, electrically coupled to each other via plug-side current direction-limiting means;

said plurality of electrical contacts disposed about said inner periphery of said receptacle means comprising first and second socket contacts, situate in said receptacle means and adapted to correspondingly come into electrical contact respectively with said plug contacts when said plug means is properly and fully matingly engaged with said socket means, said first and second socket contacts electrically coupled to each other via socket-side current direction-limiting means;

at least one additional plug contact and socket contact on each of said plug and socket means, respectively, each similarly adapted to come into electrical contact with each other when said plug means is fully matingly engaged with said socket means;

wherein said plug and socket means are each adapted to be used with circuit isolation means capable of only permitting flow of electrical current through said at least one additional plug and socket contact when current flow through at least one of said plug side and socket side current direction-limiting means is detected.

9. Plug and socket means adapted for positioning within two separate threaded tubular housings and adapted to permit electrical communication between components situated in each of said separate threaded tubular housings and further adapted for mating engagement upon rotatable engagement of said two separate threaded tubular housings with each other;

said plug means comprising:

a) an elongate male member, having a plurality of electrical contacts about an outer periphery thereof;

b) a resiliently-biased sheath member, slidably biased over said male member so as to substantially cover said electrical contacts on said male member, which upon application of force thereto is slidably moveable so as to uncover said electrical contacts; and c) biasing means for biasing said slidable sheath member over said male member;

said socket means comprising:

a) elongate receptacle means having disposed about an inner periphery thereof a plurality of electrical contacts, said electrical contacts adapted to contact said electrical contacts respectively on said male member when said male member is inserted in said receptacle means;

b) resiliently-biased protective means displaceable from said receptacle means so as to permit insertion of said male member within said receptacle means; and c) biasing means, biasing said protective means so as to substantially prevent ingress of foreign material into said receptacle means when said male member is not yet inserted in said receptacle means;

whereby said male member is adapted for insertion in said receptacle means upon mating engagement of said plug means with said socket means.

10. The plug and socket means as claimed in claim 9, said resiliently-biased protective means comprising a piston member, slidably-biased within said receptacle means, adapted to cover said inner periphery of said receptacle means when said male member is not yet inserted in said receptacle means.

11. The plug and socket means as claimed in claim 9, further comprising self-alignment means for guiding said plug means into mating engagement with said socket means.

12. The plug and socket means as claimed in claim 11, wherein said self-alignment means comprise corresponding taper interfaces respectively on said plug means and said socket means.

13. The plug and socket means as claimed in claim 9, wherein said threaded tubular housings are drill pipes.

14. The plug and socket means as claimed in claim 10 wherein said piston member is resiliently biased and is displaceable from within said receptacle means upon insertion of said male member therein.

15. The plug and socket means as claimed in claim 9, 10, or 14 wherein said plug means is rotatable relative to said socket means to permit said socket means to rotate relative to said plug means during rotatable mating engagement of said two separate threaded tubular housings with each other.

16. The plug and socket means as claimed in claim 9, 10, or 14;

said socket means further comprising means for contacting said sheath member upon mating engagement of said plug means with said socket means, so as to cause said sheath member to be slidably displaced from a position covering said male member as said male member is inserted in said receptacle means.

17. The plug and socket means as claimed in claim 9 wherein:

said plug means is adapted for positioning within an interior of a first of said two separate threaded tubular housings proximate an end thereof adapted for mating engagement with a mating end of a second of said two separate threaded tubular housings, and said socket means is adapted for positioning within an interior of said second of said two separate threaded tubular housings proximate said mating end thereof; and said male member is inserted in said receptacle means upon said first threaded tubular housing being fitted in mating engagement with said second threaded tubular housing.

18. The plug and socket means as claimed in claim 17, further comprising third biasing means adapted, when said plug means and said socket means are in mated engagement, to exert a force so as to maintain said plug means in mating engagement with said socket means.

19. The plug and socket means as claimed in claim 18, said socket means contained in a first pressure housing, said first pressure housing attachable to an interior of said first threaded tubular housing;

said plug means contained in a second pressure housing, said second pressure housing positionable within an interior of said second threaded tubular housing;

said second pressure housing slidably moveable within a third pressure housing, said third pressure housing attachable to an interior of said second threaded tubular housing; and said second pressure housing matingly engageable with said first pressure housing along a common longitudinal axis.

20. The plug and socket means as claimed in claim 19, said second pressure housing having an area of restricted cross-sectional area so as to present a surface area normal to said longitudinal axis of said first and second pressure housing so that ambient pressure within said first and second threaded tubular housings acts on said surface area so as to cause said second housing to be biased in mating engagement with said first housing.

21. The plug and socket means as claimed in claim 18, said plug means contained in a first pressure housing, said first pressure housing attachable to an interior of said first threaded tubular housing;

said socket means contained in a second pressure housing, said second pressure housing positionable within an interior of said second threaded tubular housing;

said second pressure housing slidably moveable within a third pressure housing, said third pressure housing attachable to an interior of said second threaded tubular housing; and said second pressure housing matingly engageable with said first pressure housing along a common longitudinal axis.

22. The plug and socket means as claimed in claim 19, wherein said third biasing means comprises a compression spring to compensate for axial misalignment between said first and second pressure housings.

23. The plug and socket means as claimed in claim 21, said second pressure housing having an area of restricted cross-sectional area so as to present a surface area normal to said longitudinal axis of said first and second pressure housing so that ambient pressure within said first and second threaded tubular housings acts on said surface area so as to cause said second housing to be biased in mating engagement with said first housing.

24. The plug and socket means as claimed in claim 9, wherein said threaded tubular housings are drill collars.

25. A method for establishing electrical communication between a plug means in a first threaded tubular housing and a socket means in a second threaded tubular housing, comprising the steps of:

i) positioning said plug means within an interior of said first threaded tubular housing, proximate to a first end thereof;

ii) positioning said socket means within an interior of said second threaded tubular housing, proximate to a first end thereof, said first end of said first threaded tubular housing adapted for rotatable engagement with said first end of said second threaded tubular housing;

iii) rotatably securing said first end of said first threaded tubular housing to said first end of said second threaded tubular housing, while at the same time simultaneously:

a) inserting a male member having a plurality of electrical contacts thereon arranged about an outer periphery and situate within said first threaded tubular housing, into a receptacle means having a plurality of mating electrical contacts thereon arranged about an inner periphery thereof so that each respective electrical contacts on said male member come into respective contact with said electrical contacts within said receptacle means;

b) displacing, with said male member, a resiliently biased piston member situate in said receptacle means; and c) displacing, with said socket means, a sheath member covering said male member.

26. The method as claimed in claim 25, wherein said threaded tubular housings is drill pipe.

27. The method as claimed in claim 25, wherein said threaded tubular housings is drill collar.

* * * * *